US010087595B2

(12) United States Patent
Williamson

(10) Patent No.: US 10,087,595 B2
(45) Date of Patent: Oct. 2, 2018

(54) SUPPORT FOR AN EXCAVATION

(71) Applicant: Perry Williamson, Sible Hedingham (GB)

(72) Inventor: Perry Williamson, Sible Hedingham (GB)

( * ) Notice: Subject to any disclaimer, the term of this patent is extended or adjusted under 35 U.S.C. 154(b) by 0 days.

(21) Appl. No.: 14/352,032

(22) PCT Filed: Oct. 29, 2012

(86) PCT No.: PCT/GB2012/052688
§ 371 (c)(1),
(2) Date: Apr. 15, 2014

(87) PCT Pub. No.: WO2013/061093
PCT Pub. Date: May 2, 2013

(65) Prior Publication Data

US 2014/0270987 A1 Sep. 18, 2014

(30) Foreign Application Priority Data

Oct. 28, 2011 (GB) ..... 1118699.6

(51) Int. Cl.
*E02D 17/08* (2006.01)

(52) U.S. Cl.
CPC ..... *E02D 17/08* (2013.01)

(58) Field of Classification Search
CPC ..... E02B 3/108; E02D 17/08; E04H 15/20
USPC ..... 405/107, 110, 111, 115, 282
See application file for complete search history.

(56) References Cited

U.S. PATENT DOCUMENTS 3,213,628 A * 10/1965 Serota ..... 405/111
3,999,879 A * 12/1976 Stachiw ..... E01D 15/20 14/27
4,650,368 A * 3/1987 Bayer ..... 405/111
5,052,851 A * 10/1991 Frishauf ..... E02D 29/14 404/25
5,967,694 A * 10/1999 Covarrubias ..... E01C 9/08 14/2.6
5,988,946 A * 11/1999 Reed ..... 405/115
6,715,960 B2 * 4/2004 Metz ..... 405/116
(Continued)

FOREIGN PATENT DOCUMENTS

DE 35 23 869 9/1986
EP 2 256 252 12/2012
(Continued)

OTHER PUBLICATIONS

International Search Report for International Application No. PCT/GB2012/052688 dated May 6, 2013 (4 pages).
(Continued)

*Primary Examiner* — Tara Mayo-Pinnock
(74) *Attorney, Agent, or Firm* — Merchant & Gould P.C.

(57) ABSTRACT

A support has an expandable enclosure for use in an excavation. The enclosure is expandable, on introduction of a fluid to the enclosure, from an unexpanded configuration to an expanded configuration. The enclosure is configured such that when the enclosure is in the expanded configuration, and is located in the excavation, pressure exerted by the fluid on an internal surface of the enclosure is sufficient to provide support for at least one wall of the excavation.

3 Claims, 7 Drawing Sheets

(56) References Cited

U.S. PATENT DOCUMENTS

| | | | | |
|---|---|---|---|---|
| 8,092,116 | B1 * | 1/2012 | Asplin | E01C 23/10 404/78 |
| 8,500,365 | B1 * | 8/2013 | Vecherin et al. | 405/115 |
| 8,956,077 | B2 * | 2/2015 | Abeles | 405/111 |
| 2003/0077122 | A1 * | 4/2003 | Carnahan et al. | 405/21 |

FOREIGN PATENT DOCUMENTS

| | | |
|---|---|---|
| GB | 1 396 028 | 5/1975 |
| GB | 1 579 377 | 3/1978 |
| GB | 2 200 155 | 7/1988 |
| GB | 2 354 021 | 3/2001 |
| JP | 55-26367 | 2/1980 |
| JP | H06-257153 A | 9/1993 |
| JP | 8260466 | 3/1995 |
| JP | H08-199573 A | 8/1996 |
| JP | 2002-275897 | 9/2002 |

OTHER PUBLICATIONS

United Kingdom Search Report for GB1118699.6 dated Nov. 24, 2011 (12 pages).
Search Report for British Patent Application No. 1500372.6, dated Sep. 10, 2015.

* cited by examiner

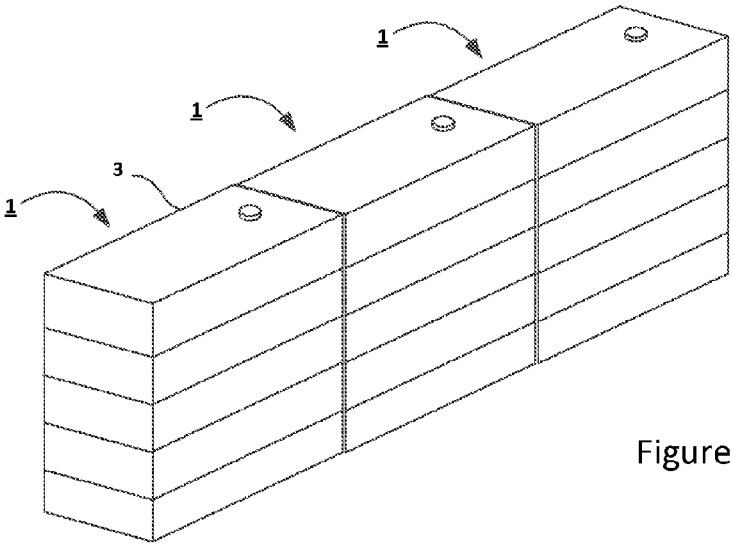
Figure 2a
Figure 2b
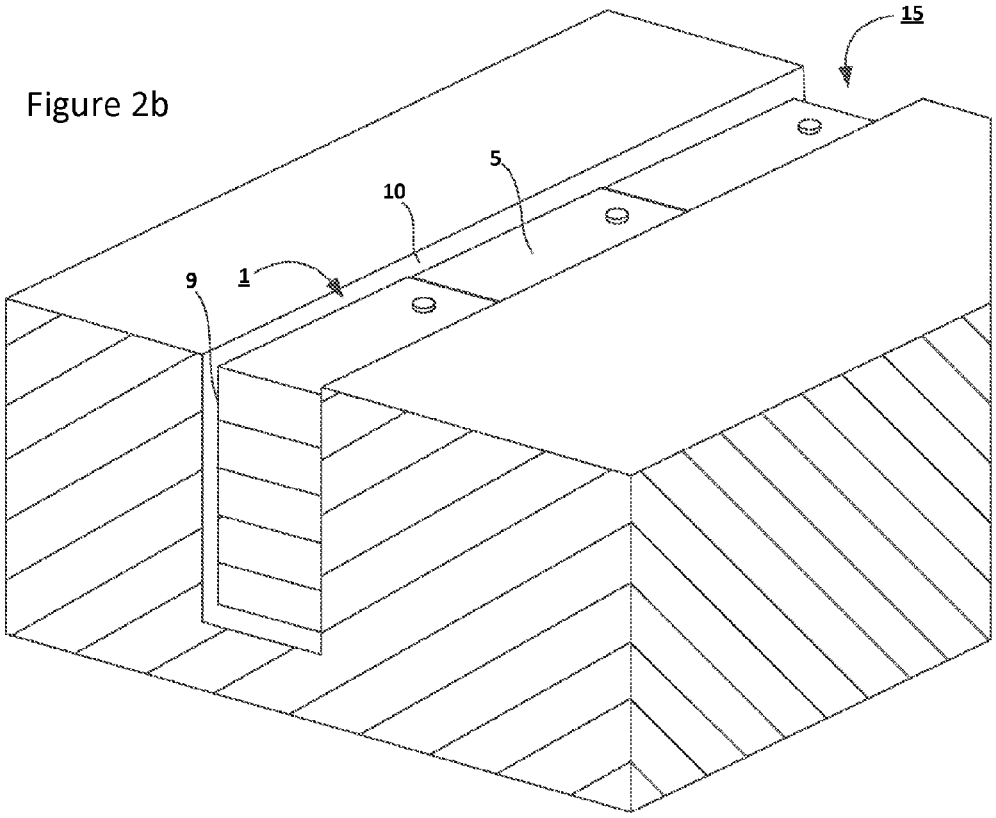

SUPPORT FOR AN EXCAVATION

This application is a National Stage Application of PCT/GB2012/052688, filed 29 Oct. 2012, which claims benefit of Serial No. 1118699.6, filed 28 Oct. 2011 in Great Britain and which applications are incorporated herein by reference. To the extent appropriate, a claim of priority is made to each of the above disclosed applications.

BACKGROUND

The present invention relates to a support for an excavation. More particularly, the present invention relates to a support for use in supporting a wall of an excavation.

When preparing a foundation for a building and in many other scenarios such as road works, utility repairs or the like, excavation of trenches is often required. Trenches are usually formed by digging out soil from the ground to a specific depth and width to form a channel along the ground. Diggers or excavators are often used to do this. Trenches can also be dug out manually by a worker.

The surface above and around the excavated trench area is often unstable and the walls of the trench are therefore susceptible to collapsing or caving in. This is a particular issue during or after heavy rain or other similar extreme environmental conditions. Therefore the trench can be a hazard to a worker within the trench or standing beside or within a vicinity of the trench. Excavation work must be carefully planned and supervised to prevent such accidents.

Furthermore, the weight of machinery such as a digger travelling along the trench could cause the walls of the trench to collapse and the digger could fall into the trench thereby causing damage to the digger as well as being hazardous to the digger operator and those in close proximity to the digger.

It is also difficult to see trenches due to their formation in the ground with no visible markers. Therefore, a person walking in the vicinity of the trench may not see the trench and could fall into it.

A need therefore exists to alleviate some of the above-mentioned problems.

SUMMARY

According to one aspect of the present invention, there is provided a support for use in an excavation. As excavations such as trenches are prone to collapsing, it is an advantage to have a support to hinder the collapse. The support comprises an enclosure which is expandable on introduction of a fluid (e.g. air, gas or liquid) to the enclosure, from an unexpanded configuration to an expanded configuration. The unexpanded configuration allows a space-saving capability for storage and transport. It also makes it easily portable for carrying about a person. When the enclosure is in the expanded configuration, and is located in the trench, the pressure exerted by the fluid on an internal surface of the enclosure is sufficient to provide support for at least one wall of the trench. The enclosure therefore acts to hinder the collapse of the trench by providing a rigid surface, when in the expanded configuration, to rest against the walls of the trench. The enclosure may conform to the shape of at least a portion of the trench when in said expanded configuration. The enclosure therefore effectively fits into the trench to thereby exert a pressure on the walls of the trench to inhibit any collapse. As the enclosure conforms to the shape of the trench, an even pressure distribution can be exerted over the walls of the trench so as to provide support to the trench walls but to not influence any collapse of the trench walls which might occur if an uneven pressure distribution was apparent. The enclosure may be sized, when in the expanded configuration, to fill a volume of at least a portion of the trench. Thus, the support can be provided to fill portions of the trench during excavation and thereby prevent collapse of the trench as it is being excavated. Of course, the support can also be used within an already-excavated trench. After excavation of a certain portion of a trench, a worker can insert the support within the portion of the trench and then can work within an adjacent portion of the trench with a lower risk of the trench walls collapsing. The worker may inflate and deflate different supports to fill or unfill selected portions or segments of the trench depending on the segments of the trench which he requires access to. As the support can fill a portion of the trench and conform to the shape of the trench, it would be difficult to move the support within the trench. It would also be difficult to remove the expanded support from the trench without first placing the support in its unexpanded configuration.

According to one aspect of the present invention, there is provided a support for use in an excavation comprising a trench, the support comprising: an enclosure which is expandable, on introduction of a fluid to the enclosure, from an unexpanded configuration to an expanded configuration; wherein the enclosure comprises an inner layer comprising a material that is impermeable to the fluid which in operation is used to expand the enclosure and an outer layer comprising a pierce-resistant material; wherein the enclosure has a cross-sectional shape that is configured, such that when the enclosure is in the expanded configuration, and is located in said trench, the enclosure: (a) conforms generally to a transverse cross-section of the trench and extends transversely across at least a substantial part of a transverse width of said trench; and (b) presents a generally flat exposed surface for spanning (or 'bridging') the transverse width of said trench.

The enclosure may be configured such that when the enclosure is in the expanded configuration, and is located in said trench, pressure exerted by the fluid on an internal surface of the enclosure is sufficient to provide support for transversely opposing walls of said trench.

The enclosure may be configured to have a size such that, when the enclosure is in the expanded configuration, and is located in said trench, the surface for spanning the trench is generally vertically proximate an upper edge of said trench whereby the surface for spanning the trench is substantially flush with a ground surface surrounding said trench (e.g. having a vertical separation of no greater than 100 mm, preferably no greater than 50 mm, more preferably no greater than 20 mm).

The outer layer may be provided on part or all of the enclosure for example on at least one of: the surface for spanning the trench; a base surface of said enclosure which base surface is configured to engage with a base of said trench when the enclosure is in the expanded configuration, and is located in said trench; a plurality of trench wall surfaces of said enclosure for extending generally adjacent to (preferably abutting) respective side walls of said trench (e.g. running longitudinally along the transverse sides of the trench) when the enclosure is in the expanded configuration, and is located in said trench.

The support may further comprise at least one pressure relief valve.

The enclosure may be formed as a structure comprising a plurality of self-contained cells each of which is impermeable to the fluid which in operation is used to expand the enclosure. The cells may be arranged to provide the enclosure with an expanded configuration having a variable size depending on which of said cells are expanded in operation.

The enclosure may expand in a first direction and in a second direction orthogonal to the first direction when fluid is introduced to the enclosure. The expansion of the enclosure may occur in the first direction to a predetermined length before expanding in the second direction. For example, the enclosure may first expand in a general upwardly direction to its maximum length, defined by the elasticity and tensile strength of the enclosure material, before expanding horizontally. This is so that the upwardly expanding enclosure walls do not interfere with the walls of the trench as they expand.

The enclosure, when expanded, may be substantially cuboid shaped having a rectangular cross-section so that the support can better conform to the shape of a typical trench also having a rectangular cross-section. The cuboid shape also allows side-by-side stacking capability and enables a system of supports to be used in conjunction with one another.

The enclosure may comprise an inner layer and an outer layer, for example, wherein the inner layer comprises a material that is impermeable to the fluid used to expand the enclosure and the outer layer comprises a pierce-resistant material. This double layer provides protection to the support against deflation by piercing from sharpened objects, for example, the teeth of an excavator's bucket. If the outer layer is pierced, the inner layer prevents any fluid from escaping. The outer layer may also be impermeable to the fluid. The inner layer may also be pierce-resistant.

The support may further comprise means, such as a valve, for introducing the fluid to said enclosure in order to expand it from the unexpanded configuration to the expanded configuration. The use of the valve with the support allows an external source of the fluid, such as a pump, to be connected to the support in order to deliver the fluid (such as air) and thereby expand or inflate the enclosure. The valve may be secured against unauthorised use, for example, by providing a lock mechanism requiring authorised access to use the valve. This could be a key-lock type mechanism. Securing the valve in this manner prevents any unauthorised persons from using the support. This could, for example, prevent persons from stealing the supports. It could also prevent accidental opening of the valve which can deflate the support.

The fluid introducing means may comprise a source of said fluid, such as a gas inflating device which can be actuated to expand the enclosure. This provides an advantage that additional equipment, such as a pump, is not needed to expand the enclosure. An activation signal may be received by the fluid introducing means to actuate the expansion and a further signal may be received to prevent any further expansion of the enclosure. The further signal may be received from a pressure sensor within the enclosure which determines when a pre-determined pressure threshold has been reached. An indication (for example a visual and/or audio indication and/or a signal to stop automatic expansion) may be output when an internal pressure in said enclosure reaches the predetermined threshold. The indication allows a user to be alerted when the support has been expanded to either a desired volume (set by the user), a threshold pressure level determined by the pressure gradient between the enclosure walls and the trench walls, and/or the maximum pressure at which the support can operate (i.e. before it bursts due to over-inflation).

A rigid platform may be attached to the enclosure for bridging the trench when the support is used in the excavation. The rigid platform can provide an enhanced functionality of the support to support vehicles and the like to cross over the trench.

The enclosure may be fabricated from at least one of canvas, rubber, and/or a rigid or semi rigid plastics material. These materials can provide suitable flexibility for the expansion of the enclosure whilst also providing a durable, rigid, pierce-preventative surface for distributing a load.

The excavation may comprise at least one of a construction trench (for example the foundation trench for a building), an excavation for accessing a utility conduit (for example a gas, sewerage or water pipe, or an electricity main), or an excavation for a route repair (for example a road, rail or pathway repair).

According to another aspect of the present invention, there is provided a kit comprising a plurality of supports according to a previous aspect. The kit may further comprise means for connecting the enclosure of a support to a source of said fluid and a source of said fluid (for example a pump or compressed gas source).

According to another aspect of the present invention, there is provided a method for providing protection in an excavation. At least one support is located in said excavation. The at least one support comprising a fluid filled enclosure, wherein the fluid is under pressure against an internal surface of said enclosure and wherein the pressure exerted by the fluid on the internal surface of the enclosure is sufficient to provide support for the at least one wall of the excavation. The support thereby provides various forms of protection, including hindering any collapse of the excavation, and the fluid filled enclosure providing a raised surface to prevent a person or vehicle falling into the excavation.

At least part of the excavation may be excavated and the at least one support may be introduced to the excavation to provide the protection in the excavation.

A further part of the excavation may be excavated after the at least one support has been introduced to the excavation. At least one further support may be introduced to the excavation to provide said protection in the excavation. Therefore, a plurality of supports can be used in the trench to enhance protection in the trench.

The at least one further support may comprise a fluid filled enclosure, wherein the fluid is under pressure against an internal surface of said enclosure and wherein the pressure exerted by the fluid on the internal surface of the enclosure is sufficient to provide support for the at least one wall of the excavation.

The at least one support may be introduced to the excavation in an unexpanded configuration and a fluid may then be introduced to expand the enclosure to an expanded configuration in which the enclosure provides the protection in the excavation.

According to another aspect of the present invention there is provided a support for use in an excavation to provide protection. The support comprises a fluid filled enclosure, wherein the fluid is under pressure against an internal surface of said enclosure. The enclosure is configured such that when it is located in said excavation, the pressure exerted by the fluid on the internal surface of the enclosure is sufficient to provide support for at least one wall of the excavation.

According to another aspect of the present invention there is provided an inflatable trench support for use in a trench. The support comprises an enclosure configured for inflation. The enclosure has a deflated configuration and an inflated configuration. When the enclosure is in the inflated configuration and is located in the trench, it can provide support for at least one wall of said trench.

It will be appreciated the term 'fluid' as used herein includes liquids such as water and gases such as nitrogen, air, carbon dioxide and the like.

BRIEF DESCRIPTION OF THE DRAWINGS

The present invention will now be described, by way of example only, with reference to the accompanying figures, in which:

FIG. 2*a* is a simplified view of the inflated trench support system;

FIG. 2*b* is a simplified view of the inflated trench support system in use;

DETAILED DESCRIPTION

Overview

Embodiments of the present invention relate to an expandable or inflatable support for use in an excavation, for example to support a wall of an excavated trench. The inflatable trench support is used for distributing a load, such as an inward pressure from the trench walls, over its surface area in order to support and uphold the trench walls, thereby preventing collapse of the trench walls and also preventing a person from falling into the trench. It does this by fitting into the trench and filling or at least partially filling the trench.

Figure 1A:
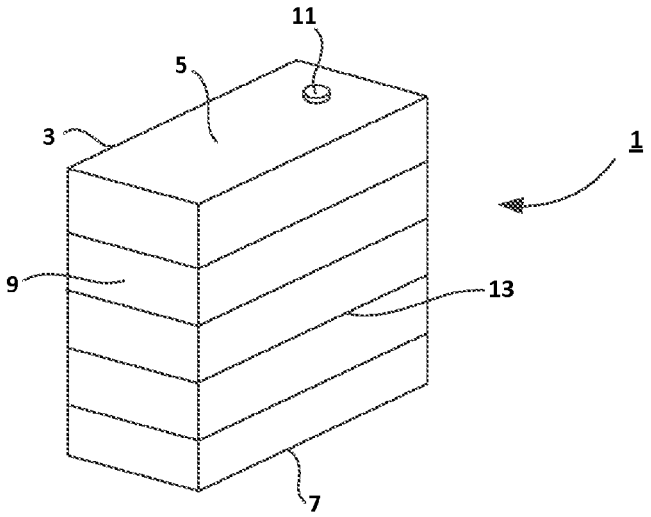
FIG. 1*a* is a simplified isometric view of the inflated trench support.

FIG. 1*a* shows an inflatable trench support 1 in an inflated configuration. The inflatable trench support 1 of this embodiment comprises an enclosure 3 having a generally cuboid shape with a generally rectangular cross-section. The enclosure 3 in its inflated configuration has a first end wall 5, a second end wall 7 and four side walls 9. The first end wall 5 comprises a valve 11 which is configured for connection to a pump (see FIG. 3*a*) for inflation and is also used to deflate the inflatable trench support 1 by release of the fluid used to inflate it. In this embodiment a plurality of 'fold-lines' 13 are also present around the perimeter of the cuboid, in the side walls 9, and at discrete intervals along a major length of the cuboid between, and generally parallel to, the first and second end walls 5 and 7.

In the inflated configuration, the enclosure 3 forms a relatively rigid support that is capable of supporting a load. The enclosure 3 is relatively rigid due to the internal pressure of the fluid used to inflate the enclosure 3. The generally flat surfaces of the cuboid enclosure 3 allows the inflatable trench support 1 to stand upright on any of its surfaces, but preferably with the second end wall 7 against the ground so the valve 11 is easily accessible to an operator.

Figure 1B:
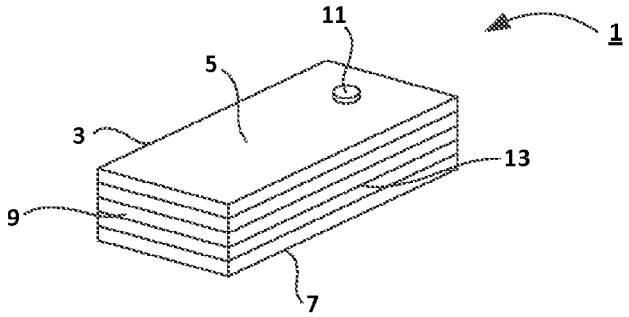
FIG. 1*b* is a simplified isometric view of the deflated trench support.

FIG. 1*b* shows an inflatable trench support 1 in a deflated or uninflated configuration whereby the enclosure 3 is compressed along its fold lines 13, in the manner of a concertina, so that the fold-lines 13 are brought together.

FIG. 2*a* shows a general alignment of multiple inflatable trench supports 1. The cuboid shape of the enclosure 3 allows several similar inflatable trench supports 1 to be arranged side-by-side in a trench or else stacked for storage and/or for transportation.

Whilst a trench is being excavated, an inflatable trench support 1 can be positioned in the trench as soon as an appropriately sized section of the trench has been excavated, before the trench is complete. In this manner each trench support can be placed in its respective section of trench before the next section of the trench 15 is excavated thereby safely supporting the walls of the partially excavated trench from collapse, for example under the weight of the vehicle used to excavate the trench.

FIG. 2*b* shows the multiple inflatable trench supports 1 of FIG. 2*a* in their inflated configuration in a trench 15. As shown, the inflatable trench supports 1 substantially fill a sub-section or portion of the trench 15. The enclosure side walls 9 are brought into contact with the walls 10 of the trench. For illustrative purposes, the inflatable trench supports 1 are shown with their first end wall 5 surfaces below the ground level of the trench, however, they may be configured so that the first end wall 5 surfaces are substantially flush with the ground level or, in some configurations, above the ground level.

Operation

Figure 3A:
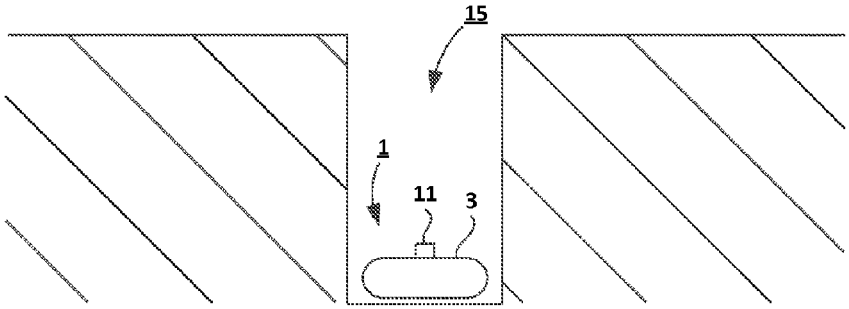
FIG. 3*a* is a simplified cross-sectional view of the deflated trench support within a trench.
Figure 3B:
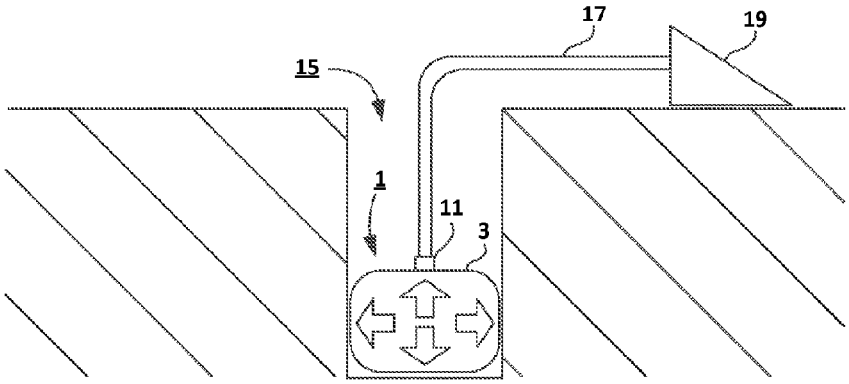
FIG. 3*b* is a simplified cross-sectional view of the trench support in a partially inflated state within the trench.
Figure 3C:
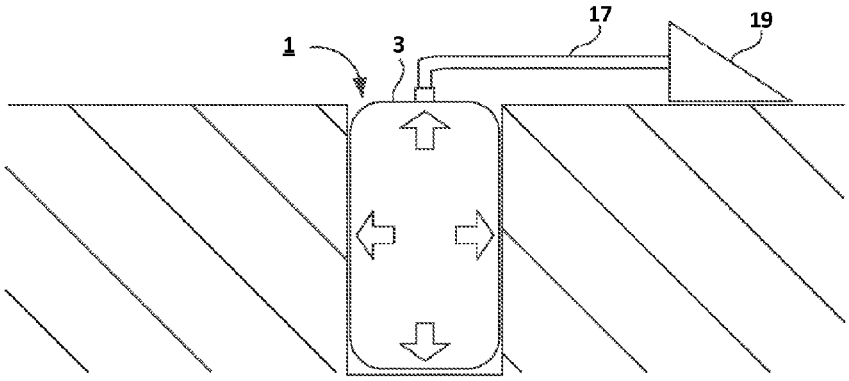
FIG. 3*c* is a simplified cross-sectional view of the inflated trench support within the trench.

FIGS. 3*a*, 3*b* and 3*c* show a method of installing the inflatable trench support 1 within the trench 15.

Firstly, as shown in FIG. 3*a*, the inflatable trench support 1, in its compressed configuration shown at FIG. 1*a*, is placed at the bottom of the trench 15.

As shown in FIG. 3*b*, a pump hose 17 of a pump 19, such as a foot pump or electric pump 19, is then attached to the valve 11 of the inflatable trench support 1 so that the inflatable trench support 1 can be inflated to expand and fill the trench 15. In another example, the pump hose 17 can be attached to the inflatable trench support 1 before placing the inflatable trench support 1 within the trench 15. This would help to avoid a user of the inflatable trench support 1 from having to climb into or lean over the trench 15 in order to connect the pump hose 17 to the valve 11.

After connecting the pump 19 or other means for expansion, the enclosure 3 is then fluidly-filled in order to expand. In this embodiment, the pump 19 is operated to inflate the inflatable trench support 1 with air or gas. In one configuration, the enclosure 3 is configured to first expand in an upwardly direction to fill the height of the trench 15 before expanding in a generally horizontal direction to fill the width of the trench 15. In other configurations, the inflatable trench support 1 is configured to expand height-wise as well as width-wise substantially at the same time. There are many methods known in the art of configuring the enclosure 3 to expand in a first direction before expanding in a second direction. For example, the enclosure 3 could house multiple, inter-connected, and segmented chambers whereby selected chambers can be made, by design, to be inflated before the other chambers inflate.

FIG. 3*c* shows the inflatable trench support 1 in its inflated configuration. At this inflated stage, the pump inflation can be stopped and the pump 19 removed. If required (depending on the type of valve used), the valve can then be sealed to prevent the fluid from escaping the enclosure 3 and subsequently releasing any pressure. The amount of inflation, and hence expansion of the enclosure 3, is variable. In one embodiment, the inflated configuration could be a partial inflation of a maximum inflation amount. In other embodiments, it could be the full inflation to the maximum inflation amount. Furthermore, the amount of inflation in the inflated configuration could be pressure-dependent, whereby the inflation is ceased when a pressure threshold is satisfied.

Figure 4:
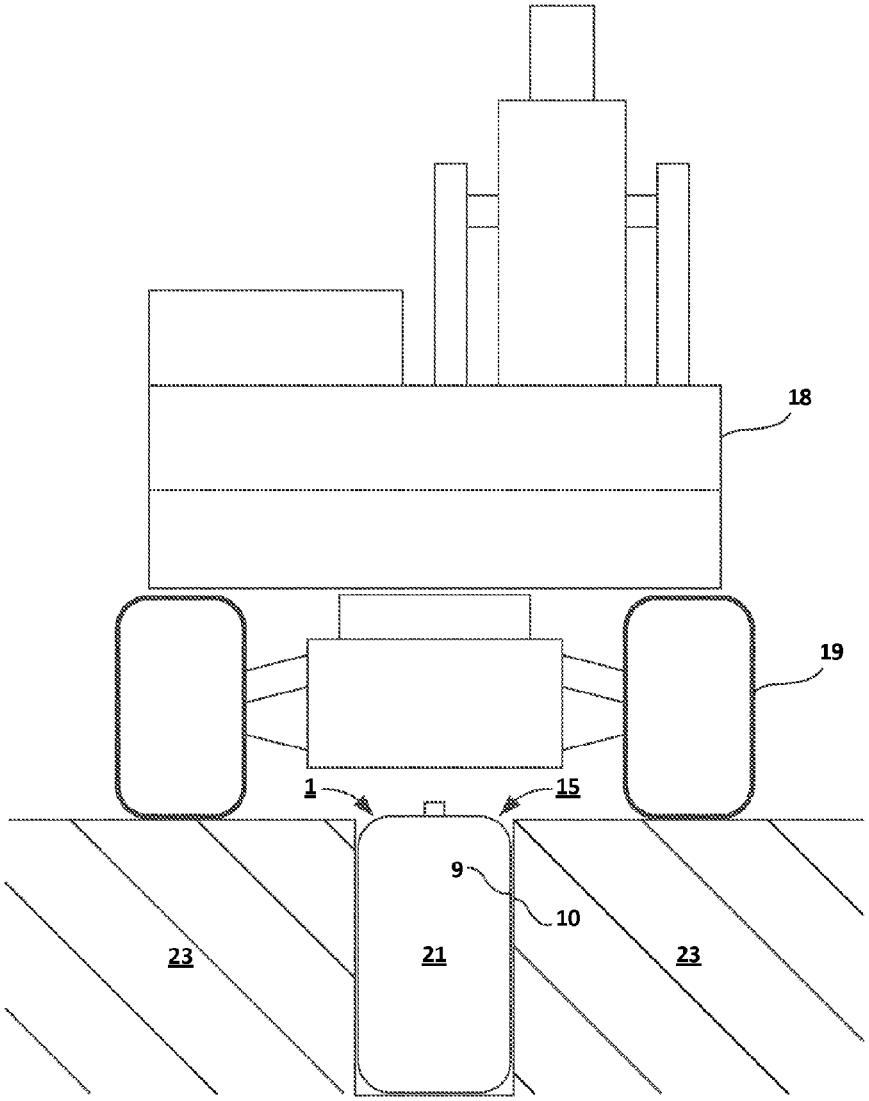
FIG. 4 is a simplified cross-sectional view of the inflated trench support in operation.

FIG. 4 shows the inflatable trench support 1 acting to support, and thereby prevent, the walls 10 of the trench from collapsing when machinery such as a digger or an excavator vehicle 18 is travelling above and along the length of the trench 15.

As the excavator 18 travels along and above the trench 15 so that the channel of the trench 15 runs between the excavator's wheels 19, a force is exerted towards the ground due to gravity acting on the excavator 18. The forces acting on the ground tend to behave such that they push the soil in a downwardly manner. As the excavated area 21 of the trench 15 is open, the excavated area forms a least resistive force area. A pressure gradient is therefore formed between the surrounding ground area 23 and the excavated area 21 where the pressure is lower in the excavated area 21 than the surrounding ground area 23. Thus, in the presence of the excavator, there is an even greater risk of trench wall collapse and this risk can be further exacerbated in the presence of moisture from rain or frost.

The use of the inflatable trench support 1 within the trench 15, when in the inflated configuration allows additional support to be provided to prevent the trench walls 10 from collapsing into the excavated area 21 of the trench 15. This is achieved as a result of the internal pressure of the fluid used to inflate the enclosure 3 acting against an internal surface of the enclosure 3 and thereby providing an opposing force which, in operation, acts to support the soil of the trench walls 10. Advantageously, because the side walls 9 of the enclosure 3 are of a relatively large surface area (of a similar surface area to the respective section of trench wall 10 that they support) and because there is relatively little (if any) gap between adjacent trench supports in operation, the forces from the trench walls are distributed over a relatively wide area. Further, an entire length of trench can be supported relatively quickly and easily because of the ease with which the support can be installed compared with, for example, using a prop to support a board placed against the trench walls.

Construction and Load-Bearing Capacity

The enclosure 3 is made from strong, durable material that is flexible and, when the enclosure 3 is inflated, resilient. The material is also resistant against penetration from sharpened objects.

In this embodiment, the enclosure 3 has at least an outer layer of canvas, however, any other suitable material can also be used, such as rubber, a rigid or semi rigid plastics material, silicon, nylon or neoprene.

In this embodiment, the enclosure 3 of the inflatable trench support 1 is configured to fit in a trench 15 having a height of approximately 1 meter and a width of approximately 0.45 meters. In general terms, the inflatable trench support 1 can be used to support a wide range of trenches 15 and can therefore be varied in size, either by imposing manufacturing size limits with a range of different sized products, or by choosing the inflation characteristics such that the inflatable trench support 1 can be inflated at different levels of inflation, providing a range of different sizes. Preferably, however, they are designed for any industry that requires the use of excavations such as the construction, service/utility, and/or route repair industries and therefore will be of a size suitable for use in various "standard size" trenches appropriate to that particular industry. For example, the support may be designed for use in standard size building foundation trenches. By way of illustration, in the case of a domestic dwelling, the foundation trenches will generally be smaller than the trenches used for multi-storey office buildings or car parks. In the case of trenches for accessing utilities such as gas, water or electricity conduits, these will generally be of a different size depending on the utility and/or the type of work being carried out. It is envisaged that the enclosure 3 will generally be designed to inflate to a maximum size which may be between 0.5 meters and 2.5 meters in height, between 0.3 meters and 1 meter in width, and between 0.5 meters and 3 meters in length. However, much larger (or smaller) sizes are, of course, possible. Further, it will be appreciated that supports could be stacked or placed next to one another to fill an excavation that is wider than the individual width of each maximally inflated support. Further, supports designed with different sizes in each dimension could be used in different orientations depending on the size of the excavation being supported.

In a particularly advantageous embodiment at least one of the support dimensions corresponds to the width of a standard bucket of an excavator/digger. Different dimensions (e.g. length, width, height) could each correspond to a differently sized bucket width.

Typically, an inflatable trench support 1 will be capable of supporting, when in its inflated configuration, a load of at least a person of 100 kilograms. Nevertheless, it is envisaged that each support will be able to support the load of an excavator (which may, for example, weigh anything from a few hundred kilograms to a couple of tonnes). Further, the inflatable trench support 1 is configured to distribute a load over its relatively large area surfaces, for example the pressure from the walls of the trench. As such, the supports are capable of inhibiting an inward collapse of the trench walls when a typical mini-digger of weight 750 kilograms (or possibly more) is travelling above and along the trench. Typically, for example, in its inflated state, the support will be able to handle a maximum external force of at least 1000N being exerted on a relatively small area of about 0.05 $m^2$ to 0.1 $m^2$ (~10 $kN/m^2$ to ~20 $kN/m^2$) without bursting. Preferably, however, the support will be able to survive a maximum external pressure of at least 10 $kN/m^2$, more preferably at least 100 $kN/m^2$, more preferably at least $10^3$ $kN/m^2$, still more preferably at least $2.5\times10^3$ $kN/m^2$. The support is also preferably able to survive the impact force associated with a 2 tonne vehicle falling from a height of approximately 0.5 m.

Figure 7A:
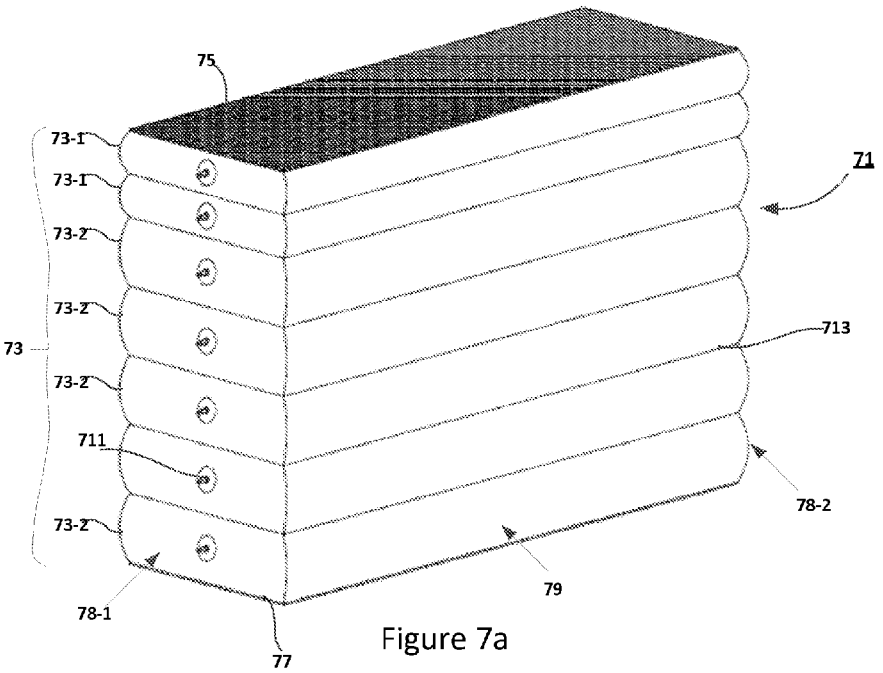
FIGS. 7*a* to 7*d* respectively show a simplified isometric view, a simplified front view, a simplified rear view and a simplified top view of another trench support.
Figure 7B:
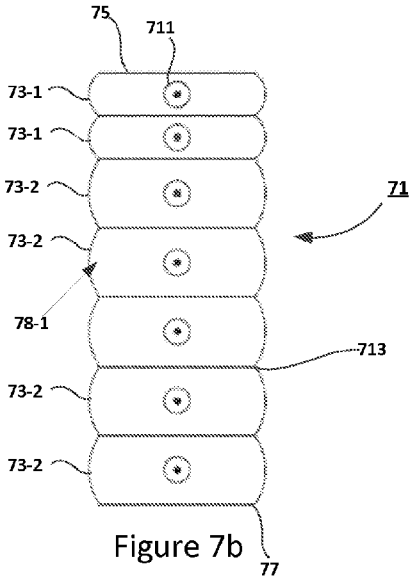
Figure 7C:
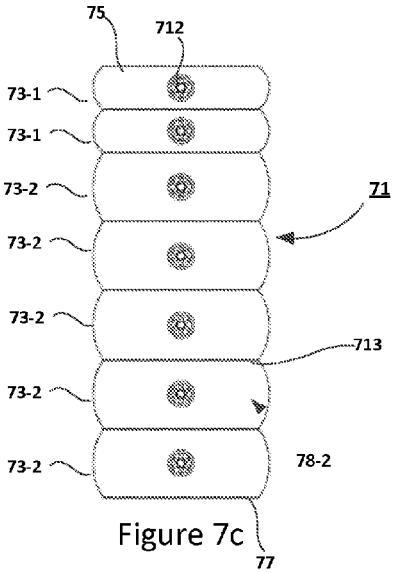
Figure 7D:
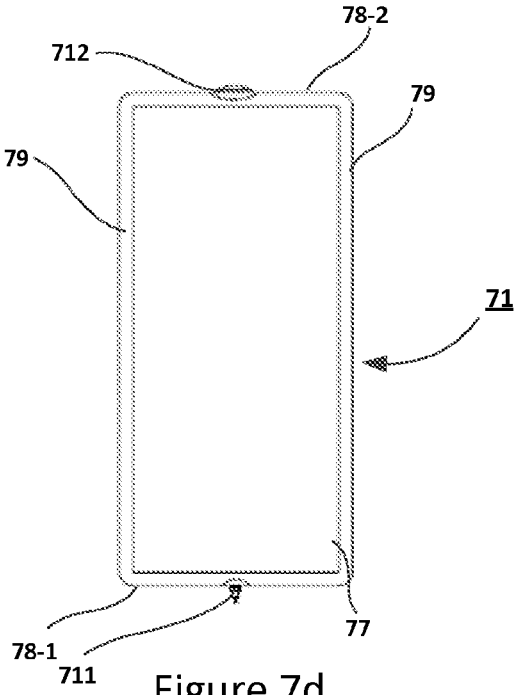
Figure 7E:
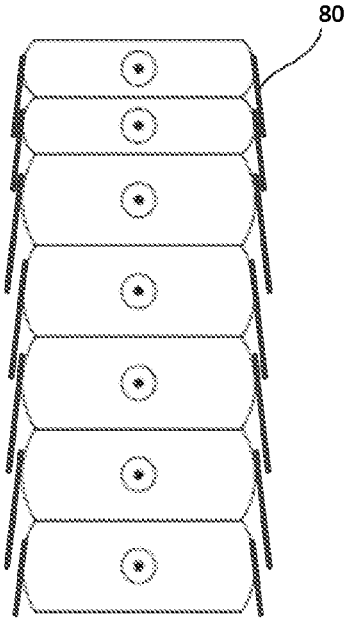
FIG. 7*e* shows a simplified front view of a variation of the trench support of FIGS. 7*a* to 7*d*.

FIGS. 7*a* to 7*d* show another example of an inflatable trench support 71 in an inflated configuration and FIG. 7*e* shows a variation on this example. Like the example of FIG. 1, the inflatable trench support 71 of this embodiment comprises an enclosure 73 having a generally cuboid shape with a generally rectangular cross-section. Unlike the example of FIG. 1, however, the trench support of FIGS. 7*a* to 7*d* is formed as a modular (or 'cellular') structure in which the enclosure 73 comprises a plurality of (in this example seven) individual enclosure modules (or 'cells') 73-1 and 73-2.

In this embodiment the modules 73-1 and 73-2 are stacked vertically relative to the orientation of the trench support during normal use although it will be appreciated that whilst this arrangement is particularly advantageous (e.g. to provide an adjustable height) the modules may alternatively or additionally be arranged longitudinally adjacent one another (e.g. to provide adjustable length and/or adjustable width).

Referring to the trench support when oriented in its normal operational position, as shown in FIG. 7*a*, the modules 73-1 and 73-2 all have approximately the same dimensions horizontally in the longitudinal and transverse directions. However, different modules 73-1 and 73-2 have different vertical heights. Specifically, in this embodiment the upper two modules 73-1, relative to the normal operational position, have respective heights that are substantially equal to one another, but have a smaller height than the other five modules 73-2. The remaining five modules 73-2 have respective heights that are substantially equal to one another.

In this example, the upper two modules 73-1 are approximately 125 mm in height (within an approximate 10% tolerance) whereas the other five modules are approximately 200 mm in height (within an approximate 10% tolerance).

It can be seen that the use of the modular structure advantageously provides a flexible height and provides some redundancy in the event of individual module failure. For example, when all the modules 78-1 and 78-2 are fully inflated, the enclosure 78 is approximately 1.25 meters in height (within an approximate 10% tolerance). When only four of the larger modules 78-2 and one smaller module 78-2 are inflated, the enclosure 78 is approximately 0.925 meters in height (within an approximate 10% tolerance). When only the five larger modules 78-2 are inflated, the enclosure 78 is approximately 1.00 meters in height (within an approximate 10% tolerance). It can be seen, therefore, that the enclosure 73 can have any of a plurality of different possible inflated configurations to provide different heights and/or to take account of the failure of one or more of the modules.

It will be appreciated, that whilst the present embodiment is particularly advantageous, the size and number of modules may vary depending on the implementation (e.g. the size of the trench in which they are destined for use). Moreover, the modules may comprise modules that are all of the same height or are of three or more different heights.

The enclosure 73 has an inflated configuration similar to that shown in FIG. 1 with an inflated configuration having a first end wall 75, a second end wall 77 and four side walls 78-1, 78-2, 79. Like the example in FIG. 1, the first end wall 75 comprises a generally flat exposed surface which, in operation with the support in place in a trench, bridges (or 'spans') the transverse width of said trench thereby allowing human and or vehicle traffic to cross the support without significant hindrance. The second end wall 77 provides a generally flat base surface for engaging with a base of the trench when the support is in situ in the trench (it will be appreciated that the base surface could be configured to engage with other non-flat trench bases).

The four side walls 78-1, 78-2, 79 comprise two end surfaces 78-1, 78-2 at either longitudinal end of the trench support and two side surfaces 79 at either transverse side of the support. In operation, the two end surfaces 78-1, 78-2 lie adjacent: a trench wall at the longitudinal end of the trench; the corresponding side wall (end surface) of another trench support; or an open part of the trench. One of the two end surfaces 78-1, in this embodiment, comprises a plurality of inflation valves 711 (a respective inflation valve for each module in this embodiment) whilst the other end surface 78-2 comprises a plurality of pressure relief valves 712 (a respective pressure relief valve for each module in this embodiment) each of which is configured to release fluid in the event that a predetermined pressure is reached in order to prevent or at least inhibit over pressurisation of the enclosure or enclosure modules. It will be appreciated that the valves may be located in any suitable location. For example, the pressure relief valve and inflation valve of each module may be provided on the same surface (e.g. to provide easier access to both set of valves in a trench support at one end of a trench).

In operation, each of the two side surfaces 79 generally lie adjacent (and usually in contact with) a respective trench wall running longitudinally on either transverse side of the trench.

In an inflated configuration, therefore, the enclosure 73 forms a relatively rigid support that is capable of supporting a load. The enclosure 73 is relatively rigid due to the internal pressure of the fluid used to inflate the enclosure 73. The generally flat surfaces of the cuboid enclosure 73 allows the inflatable trench support 71 to stand upright on any of its surfaces, but preferably (in it normal operational position) with the second end wall 77 against the ground so the valves 711 and 712 are more easily accessible to an operator.

In the embodiment shown in FIGS. 7*a* to 7*d*, each module of the enclosure 73 is formed of a material that is impermeable to the fluid that is to be used to inflate the enclosure 73. The first end wall 75 and the second end wall 77 (upper and lower surfaces of the support in operation) are each provided with an additional protective layer of a generally hardwearing, pierce resistant, material to provide protection from piercing to the impermeable material when human or vehicle traffic travel over the second end wall 77. This protective layer effectively forms a reinforcing panel that prevents, or at least inhibits, piercing of the more fragile impermeable layer and hence undesirable deflation.

It will be appreciated that, although not shown on the drawings, the side surfaces 79 at either transverse side of the support and/or the end surfaces 78-1, 78-2, may also be provided with an additional protective layer of a generally hardwearing, pierce resistant, material. However, referring to the variation in FIG. 7*e* in particular, in order to facilitate inflation, deflation, and compact storage, the protective layer for each side surface 79 and/or each end surface 78-1, 78-2 may be arranged to form a plurality of separate flaps 80 of the protective material that, in the normal operational position, hang down and overlap with one another such that, when the trench support is deflated, the flaps overlap with one another to form a more compact structure for storage.

Modifications and Alternatives

Detailed embodiments have been described above. As those skilled in the art will appreciate, a number of modifications and alternatives can be made to the above embodiments whilst still benefiting from the inventions embodied therein. By way of illustration only a number of these alternatives and modifications will now be described.

Figure 5A:
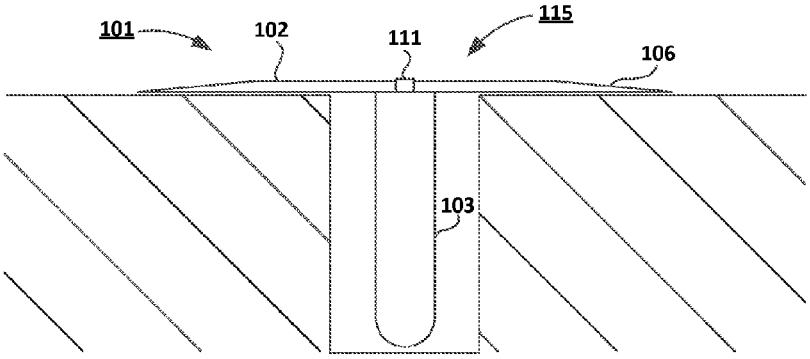
FIG. 5*a* is a simplified cross-sectional view of a modified inflatable trench support in a deflated state.
Figure 5B:
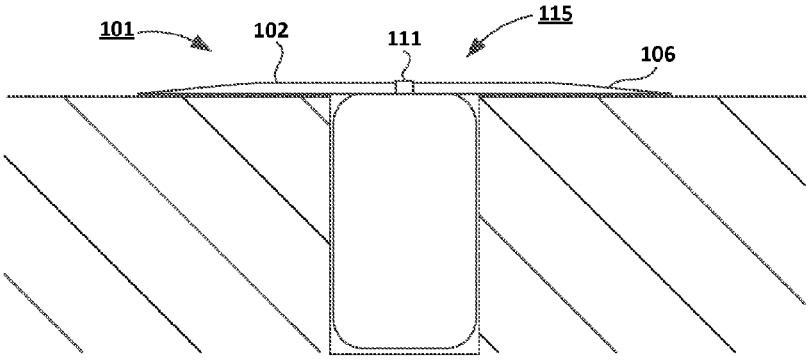
FIG. 5*b* is a cross-sectional view of the modified inflatable trench support in its inflated state.

In the above embodiments, the inflatable trench support 1, 71 is free standing in the trench 15. In another embodiment, and as shown in FIGS. 5*a* and 5*b*, the inflatable trench support 101 further comprises a rigid platform 102 attached to the enclosure 103. In this case, the rigid platform 102 extends across and beyond the width of the trench 115. The enclosure 103, when deflated, hangs loosely from the rigid platform 102 into the excavated area of the trench 115. The valve 111 is embedded within the rigid platform 102 so that it does not protrude above the rigid platform 102. The rigid platform 102 has tapered ends 106 allowing a vehicle to seamlessly move onto the rigid platform 102 from the ground surface in order to cross the trench 115. FIG. 5*b* shows the enclosure of this embodiment in its inflated configuration. The use of the rigid platform 102 allows the inflatable trench support 101 to be placed over and within the trench 115 without a user having to risk entering the trench 115. It also can support a person or vehicle in order to allow the people or vehicles to cross the trench 115. This avoids having to spend a large amount of time constructing make-shift platforms in order for vehicles to cross the trench 115. When not in use, the enclosure 103 of this embodiment may be folded under or into the platform 102.

Figure 6:
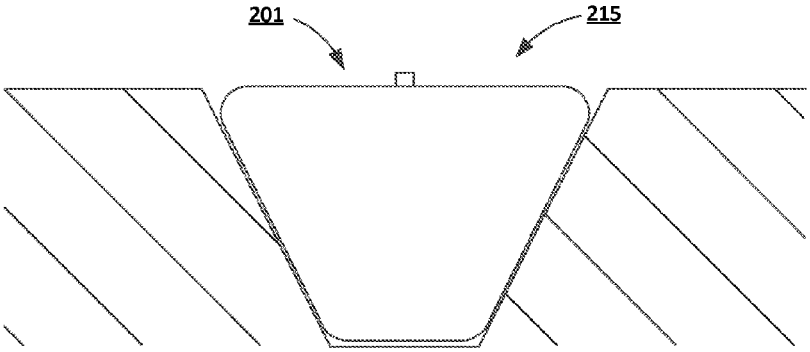
FIG. 6 is a simplified cross-sectional view of an inflatable trench support having a substantially trapezoidal cross-section.

In the above embodiments, the inflatable trench support 1, 71 was configured to form a cuboid shape when in its inflated configuration in order to fit a trench 15 having a generally rectangular cross-sectional profile. However, a trench 215 may be of a different cross-sectional profile such as having a trapezoidal cross-section as shown in FIG. 6. Thus, the inflatable trench support 201 may be configured so that, when inflated, the enclosure 203 can form a rigid support having a trapezoidal cross-section. Other shapes and sizes may also be apparent due to varying shaped trenches.

In the above embodiments, the inflatable trench support 1, 71 was described as being introduced to a trench 15 in a deflated configuration and that the inflatable trench support 1, 71 is then inflated to fill the trench 15. In other embodiments, the inflatable trench support 1, 71 can be introduced to the trench 15 in an inflated configuration. The inflated trench support could be squeezed, and then placed into the trench 15 before removing the squeezing pressure so that the support 1, 71 can conform to the shape of the trench 15.

In the above embodiment, the inflatable trench support is fluidly filled using air or gas. In other embodiments, the fluid filling may be a liquid such as water. Gases such as nitrogen may be used instead of air.

In the first above embodiment, the inflatable trench support 1 used a single layer of rubber or canvas (or the like) for the enclosure 3. It is possible that sharp objects such as stones within the trench may inadvertently pierce the single-layered enclosure 3. Therefore, as described with reference to FIGS. 7*a* to 7*d*, in any other embodiment, a double-layer penetration prevention enclosure can also be provided having an outer layer and an inner layer, such that, when the outer layer is pierced, the inner layer prevents the inflatable trench support 1 from deflating.

In the above embodiments, valves 11, 711 were used to accommodate inflation. It is possible that the valves 11, 711 could be accidently opened. Therefore, in other embodiments, a secure valve system may be provided such that the valve 11, 711 can be locked to prevent accidental or unauthorised inflation or deflation. The valve may, for example, be designed to operate with a specific compressor that needs to be connected to the valve both to inflate and to deflate the support. The valve may, of course, be located in any suitable position on the support for example in a corner of one surface In the above embodiments, the valves 11, 711 accommodated inflation by allowing the inflatable support assembly 1, 71 to connect with a pump, compressor or other inflation means 19. Manually inflating the inflatable support assembly 1 in this manner could be an arduous and time consuming task. Therefore, in other embodiments an automatic inflation means can be provided within the enclosure 3, such as a gas-actuated inflation. This could be provided in addition to or instead of the valve(s) 11, 711. An activation means such as a button, keypad (with authorisation code entry required) or key may be provided on the first end wall 5, 75 of the enclosure 3 in order to activate or deactivate the inflation. Alternatively, the automatic inflation means may also comprise a transceiver connected to a processor, whereby the activation means is a wireless signal sent from a remote device, to activate the inflation. The activation means could also be provided to deflate the inflatable trench support 1, 711.

Whilst the support is described as having a concertina style foldable construction, it will be appreciated that any suitable configuration is possible although designs with some form of folding configuration are particularly beneficial in terms of ease of use, storage and transportation.

Further typical materials that may be used for any of the above embodiments will now be described, by way of example only. The impermeable material for forming the enclosure (or cells of it) may typically comprise a so called 'drop stich' fabric which, as those skilled in the art will appreciate, is produced as a multi-layer cloth, with an extra interlocking warp. Once coated, it allows the fabrication of an air impermeable enclosure. The 'drop stich' fabric may be used to form upper and lower surfaces of the enclosure/cell whilst a different fabric, such as a hypalon coated polyester may be used to form the sides of the enclosure/cell. This arrangement is particularly beneficial as it allows the upper and lower surfaces to be kept substantially flat. The protective layer (e.g. the upper and lower reinforcing panel in FIGS. 7*a* to 7*d* and/or side protection flaps of FIG. 7*e*) may be formed of a hardwearing rubber sheet material such as that used for conveyor belting (for example 6 mm Neoprene coated conveyor belting).

It will be appreciated that whilst the support is particularly beneficial for use in supporting the walls of a trench or other such excavation. It need not be used in a manner in which the walls are actually supported but could simply be placed in the excavation, without supporting the walls, but in a manner in which pedestrians walking, and vehicles operating, in the vicinity of the excavation are protected from inadvertently falling into the trench.

In the above embodiments, the inflatable trench support 1, 71 is typically manually inflated by an operator until the operator decides to cease the inflation. The operator might decide this based on seeing that the inflatable trench support 1, 71 has been inflated to fit the trench 15. However, in this method, there is a risk of under inflating, or over inflating the inflatable trench support 1, 71. Therefore, in other embodiments, a pressure indication means is provided to indicate to the operator, the internal pressure within the enclosure 3, 73. The pressure indication means may, for example, be a pressure gauge fitted to the enclosure 3, 73 of the inflatable trench support 1, 71 and adapted to measure the internal pressure of the enclosure 3, 73. The pressure gauge can have a display means provided on an external surface of the enclosure, such as the first end wall 5, 75. Alternatively or additionally, the pressure indication means may comprise a pressure sensor within the enclosure 3, 73 which is configured to provide a signal. The signal may comprise information regarding the internal pressure of the enclosure 3, 73, or it may be an indication of satisfying a pressure threshold. In the case of information, the signal comprising the information may be sent to a display device on an external surface (such as the first end wall 5, 75) of the inflatable trench support 1, 71 or maybe transmitted wirelessly by a transmitter or transceiver within the enclosure 3 to a remote device which may then display the information. In the case of an indication, the signal comprising the indication may be sent to an alert means or may be transmitted wirelessly to a remote device. The alert means may be housed within the enclosure or placed on a surface (such as the first end wall 5, 75) of the inflatable trench support 1, 71. The alert means may be a visual or audible indicator. The pressure indication means may be connected to the automatic inflation means described above to control when the automatic inflation means should stop the inflation of the inflatable trench support 1, 71 (e.g. when a predetermined pressure threshold is satisfied).

The enclosure may be configured to have a size such that, when the enclosure is in the expanded configuration, and is located in said trench, the bridging surface spanning the trench is generally vertically proximate an upper edge of said trench whereby the bridging surface is substantially flush with a ground surface surrounding said trench (e.g. having a vertical separation of no greater than 100 mm, preferably no greater than 50 mm, more preferably no greater than 20 mm). The surface for spanning the trench is typically horizontal during normal operation when the enclosure is in an expanded configuration. The surface for spanning the trench is typically perpendicular to the side wall of the trench in operation when the support is located in the trench. This helps to avoid potential injury and allows greater flexibility to move around a site at which the trench is located.

It will be appreciated that although the support is advantageously configured to exert pressure against opposing side walls of a trench in which it is positioned it may be located loosely in the trench (even without contacting one or both of the trench side walls). In this case, the support may still help to prevent trench collapse because as the trench wall begins to move, before outright collapse, it will come into contact with the support which will then begin to support the wall and inhibit outright collapse.

It will be appreciated that whilst the invention has been described with reference to specific embodiments, those skilled in the art will appreciate that individual features of different embodiments may be taken, in isolation and combined to form different embodiments. In particular, any embodiment may be used in any of the method to the extent that it is practical to do so.

The invention claimed is:

1. A method for providing protection against trench sidewall collapse in a trench having a trench base and a plurality of trench sidewalls, the method comprising:

excavating at least part of said trench;

providing a source of a gaseous fluid;

introducing at least one trench support into said trench, the at least one trench support comprising at least one cuboid enclosure having a base, a plurality of enclosure walls, and a rigid flat top surface;

wherein the enclosure is inflatable with the gaseous fluid into an expanded configuration and which is deflatable, on removal of the gaseous fluid from the at least one cuboid enclosure, from the expanded configuration to an unexpanded configuration; and wherein the at least one cuboid enclosure is formed from a drop-stitch material and comprises an inner layer comprising a material that is impermeable to the gaseous fluid, and an outer layer comprising a pierce resistant material; and filling the at least one enclosure of each trench support with said gaseous fluid to inflate the at least one cuboid enclosure into the expanded configuration;

wherein when said cuboid enclosure has been introduced into said trench and is inflated into the expanded configuration, the base of the cuboid enclosure engages with the trench base, and each of two opposing ones of said enclosure walls engages with a respective one of two opposing trench sidewalls to exert a pressure against said trench sidewalls to inhibit said trench sidewalls from collapsing and provide said protection against trench sidewall collapse, wherein the rigid flat top surface of the cuboid enclosure bridges the trench to provide a rigid flat surface across which a vehicle can be driven; and excavating at least a further part of said trench and introducing at least one further trench support to said trench.

2. A trench support system for providing protection against trench sidewall collapse; the trench support system comprising at least one trench support located in a trench having a trench base and a plurality of trench sidewalls; wherein the at least one trench support comprises:

at least one cuboid enclosure having a base, a plurality of enclosure walls, and a rigid flat top surface; the at least one cuboid enclosure is inflated with a gaseous fluid into an expanded configuration and which is deflatable, on removal of the gaseous fluid from the at least one cuboid enclosure, from the expanded configuration to an unexpanded configuration;

wherein the at least one cuboid enclosure is formed from a drop-stitch material and comprises an inner layer comprising a material impermeable to the gaseous fluid, and an outer layer comprising a pierce resistant material; and wherein the base of the cuboid enclosure engages with the trench base, and each of two opposing enclosure walls engages with a respective one of two opposing trench sidewalls to exert a pressure against said trench sidewalls to inhibit said sidewalls from collapsing and provide said protection against trench sidewall collapse; and wherein the rigid flat top surface of the cuboid enclosure bridges an entire width of the trench to provide a rigid flat surface across which a vehicle can be driven.

3. A trench support for a trench support system, the trench support being configured to provide protection against trench sidewall collapse in a trench having a trench base and a plurality of trench sidewalls, the trench support comprising:

at least one cuboid enclosure, having a base, a plurality of enclosure walls, and a rigid flat top surface; wherein the cuboid enclosure is inflated with a gaseous fluid into an expanded configuration and which is deflatable on removal of the gaseous fluid from the at least one cuboid enclosure, from the expanded configuration to an unexpanded configuration;

wherein the at least one cuboid enclosure is formed of a drop-stitch material and comprises an inner layer comprising a material that is impermeable to the gaseous fluid, and an outer layer comprising a pierce resistant material; and wherein when said cuboid enclosure is introduced into said trench and is inflated into the expanded configuration the base of the cuboid enclosure engages with the trench base, and each of two opposing enclosure walls engages with a respective one of two opposing trench sidewalls to exert a pressure against said trench sidewalls to inhibit said sidewalls from collapsing and provide said protection against trench sidewall collapse; and wherein the rigid flat top surface of the cuboid enclosure bridges an entire width of the trench to provide a rigid flat surface across which a vehicle can be driven.

* * * * *